US005921353A

United States Patent [19]

Day

[11] Patent Number: 5,921,353

[45] Date of Patent: Jul. 13, 1999

[54] ADJUSTABLE LIFTING SLING

[76] Inventor: Steven T. Day, c/o TDS Erectors, Inc. P.O. Box 271, Ashdown, Ark. 71822

[21] Appl. No.: 08/786,826

[22] Filed: Jan. 21, 1997

[51] Int. Cl.[6] ..... B65H 59/14

[52] U.S. Cl. ..... 188/65.4; 188/65.3

[58] Field of Search ..... 188/65.4, 65.1, 188/65.2, 65.3, 65.5, 188

[56] References Cited

U.S. PATENT DOCUMENTS

| | | | |
|---|---|---|---|
| 213,165 | 3/1879 | Brice | 188/65.1 |
| 379,113 | 3/1888 | Hibberd . | |
| 558,048 | 4/1896 | Dubois | 133/24 |
| 564,012 | 7/1896 | Fraser | 188/65.4 |
| 593,256 | 11/1897 | Velie | 188/65.4 |
| 4,068,608 | 1/1978 | Hartz | 188/65.2 |
| 4,470,480 | 9/1984 | Celez | 182/5 |
| 4,830,340 | 5/1989 | Knitig | 188/65.4 X |
| 5,360,083 | 11/1994 | Hede | 188/65.4 X |

FOREIGN PATENT DOCUMENTS 2 394 303 2/1979 France .

*Primary Examiner*—Peter M. Poon
*Attorney, Agent, or Firm*—Arnold White & Durkee

[57] ABSTRACT

An adjustable lifting sling including a stationary member having one or more cam surfaces and a rotary member having one or more corresponding complementary shaped surfaces permitting a tensile member to be controllably locked between the cam and complementary shaped surfaces.

17 Claims, 8 Drawing Sheets

ADJUSTABLE LIFTING SLING

BACKGROUND OF THE INVENTION

1. Field of the Invention

The present invention relates generally to lifting devices and, more particularly, to lifting devices having a locking mechanism.

2. Background of the Invention

Lifting devices are commonly used for lifting and moving products in the marketplace. Given their widespread and increasing use, it is important that such devices be both reliable in operation and easily operated.

SUMMARY OF THE INVENTION

In accordance with one aspect of the present invention there is provided an adjustable lifting sling including a fixed member having at least one cam surface and a rotable member having at least one corresponding mating surface for adjustably locking a tensile member between the at least one cam surface and the at least one mating surface.

BRIEF DESCRIPTION OF THE DRAWINGS

The present invention will become more fully understood from the following detailed description of the preferred embodiments, taken in conjunction with the accompanying drawings in which.

DESCRIPTION OF ILLUSTRATIVE EMBODIMENTS

Figure 1B:
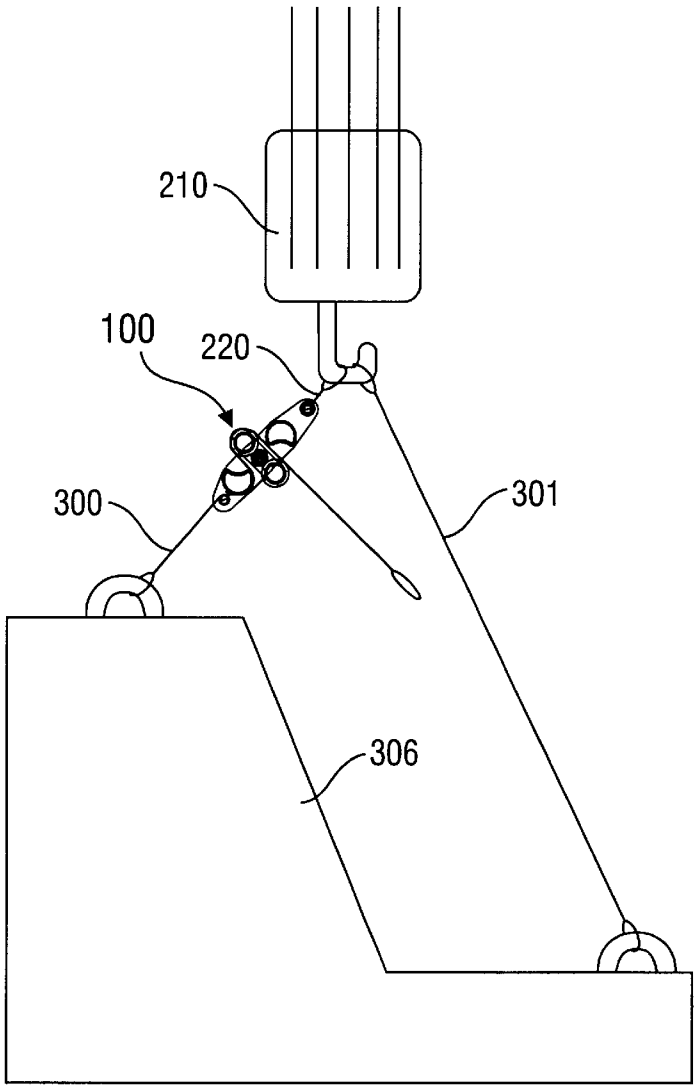
FIG. 1*b* is a front view of the use of the preferred embodiment of the lifting sling of FIG. 1*a* in an unlocked position.

The illustrative embodiments described herein provide a lifting sling for lifting and/or holding objects in a stationary position. While illustrated by means of specific illustrative embodiments providing adjustable lifting devices, the present invention will also find broad application to a wide-range of applications calling for locking or fixing the relative or absolute position of two or more objects using a flexible tensile member such as a rope, cable, chain or other similar device.

Referring initially to FIGS. 1*a*, 1*b*, 1*c*, 2*a*, 2*b*, and 3, an illustrative embodiment of a lifting sling 100 will be described. The lifting sling 100 includes a stationary member 110 and a rotating member 120.

The stationary member 110 includes a support plate 130, a support member 140, a first cam member 150, a rotating member support 160, a second cam member 170, and a support guide member 180. The support plate 130 includes a first end 190 and a second end 200. The support plate 130 provides a support structure for all of the remaining elements of the lifting sling 100. The support plate 130 may be fabricated from any number of materials having adequate tensile strength for the anticipated operational environment of the lifting sling 100 and may include materials such as, for example, metal, plastic, rubber, wood, composite, ceramic, or other similar materials. In a preferred embodiment, the support plate 130 is fabricated from steel or aluminum alloys.

As illustrated in FIGS. 1*a*, 1*b*, 1*c*, 2*a*, and 2*b*, the support member 140 permits the lifting sling 100 to be attached to a fixed or movable structure 210 by means of a conventional tensile support member 220 such as a rope, cable, chain, metal rod, or other similar device. The support member 140 may comprise any number of conventional physical structures capable of providing a physical connection between the first end 190 of the support plate 130 and the fixed or movable structure 210 using the conventional tensile support member 220. In a preferred embodiment, the support member 140 comprises a rigid post mounted perpendicular to the plane of the support plate 130 on the first end 190 of the support plate 130. The support member 140 may be attached to the support plate 130 using any number of conventional attachment methods such as, for example, mechanical fasteners, welding, brazing, or adhesive bonding. In a preferred embodiment, the support member 140 is attached to the first end 190 of the support plate by welding or using a removable pin. Alternatively, the support member 140 may be manufactured as an integral part of the support plate 130.

Figure 1A:
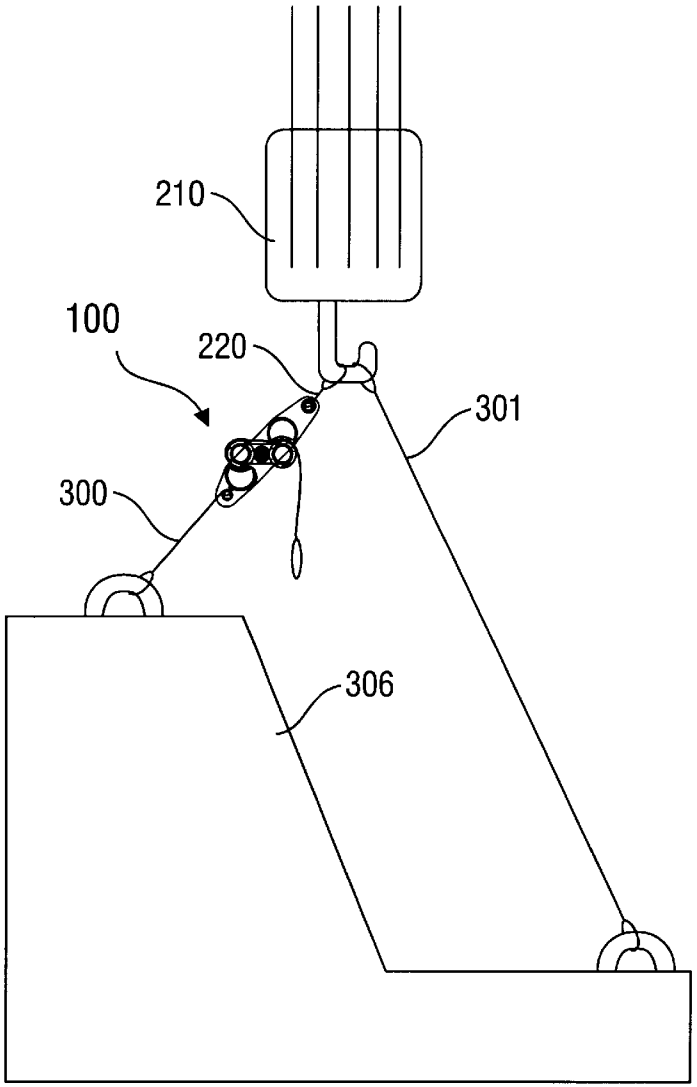
FIG. 1*a* is a front view of the use of a preferred embodiment of a lifting sling in a locked position.

The first and second cam members, 150 and 170 respectively, are rigidly attached to the support plate 130 and are preferably oriented substantially perpendicular to the plane of the support plate 130. The first and second cam members, 150 and 170 respectively, include first and second cam structures, 230 and 240 respectively, and first and second cam support structures, 250 and 260 respectively. The first and second cam structures 230 and 240 provide a locking mechanism by the interaction of their first and second cam surfaces, 270 and 280 respectively, with corresponding mating surfaces on the rotating member 120 as illustrated in FIGS. 1*a*, 1*b*, and 2.

The first and second cam members 150 and 170 are preferably positioned substantially equidistant from the pivoting axis 290 for the rotating member 120. The cross-sectional shapes of the first and second cam surfaces 270 and 280 may comprise any number of shapes such as elliptical, circular, hyperbolic, polygonal, or other similar shaped surfaces. In a preferred embodiment, the cross-sectional shapes of the first and second cam surfaces 270 and 280 are circular. In the preferred embodiment, the radii of the first and second cam surfaces 270 and 280 may range from approximately 0.17 to 0.50 feet, and preferably the radii of the first and second cam surfaces, 270 and 280 range from approximately 0.19 to 0.21 feet. The central angle of the first and second cam surfaces 270 and 280 may range from approximately 35 to 45 degrees, and in a preferred embodiment the central angle of the first and second cam surfaces 270 and 280 range from about 40 to 45 degrees. The radii and central angles of the first and second cam surfaces 270 and 280 are preferably substantially the same. The first and second cam members 150 and 170 should be oriented and sized to permit the rotating member 120 to interact with the first and second cam surfaces 270 and 280 and thereby lock together as shown in FIG. 2.

The first and second cam support structures 250 and 260 may be fabricated with any number of cross-sectional shapes such as, for example, elliptical, circular, polygonal, or other similar shapes provided they provide adequate structural support to the cam structures 230 and 240. In a preferred embodiment, the first and second cam support structures 250 and 260 are circular segments.

The first and second cam members, 150 and 170 respectively, may be fabricated from any number of conventional rigid materials such as, for example, metal, plastic, ceramic, composite, rubber, wooden or other similar materials. In a preferred embodiment, the first and second cam members 150 and 170 are fabricated from steel. The first and second cam members, 150 and 170 respectively, may be attached to the support plate 130 using any number of conventional fastenings methods such as, for example, mechanical fasteners, welding, brazing, adhesive bonding, or other similar joining methods. Alternatively, the first and second cam members, 150 and 170 respectively, may be formed integral to the support plate 130.

The rotating member support 160 provides support for the rotating member 120 and thereby permits the rotating member 120 to rotate about the rotating axis 290. The rotating member support 160 may comprise any number of conventional rotational supports such as, for example, a ball bearing, thrust bearing, journal bearing, or other similar bearing devices. The rotating member support 160 may be mounted onto the support plate 130, via an opening in the support plate 130, using any number of conventional attachment methods such as, for example, mechanical fasteners, welding, brazing, interference fit, adhesive bonds, or other similar methods. In a preferred embodiment, the rotating member support 160 comprises a bushing and shaft and is mounted onto the support plate 130 by interference fit. Alternatively, the rotating member support 160 may be manufactured as an integral part of the support plate 130.

The support guide member 180 guides the tensile member 300 which is locked in position within the lifting sling 100 by the interaction of the rotating member 120 and the cam members 150 and 170. The support guide member 180 may comprise any number of conventional devices used for guiding tensile members such as, for example, pulleys, shafts, removable pins, or other similar devices. In a preferred embodiment, the support guide member comprises a removable pin. The support guide member 180 may be mounted onto the support plate 130, via an opening in the support plate 130, using any number of conventional attachment methods such as, for example, mechanical fasteners, welding, brazing, interference fit, adhesive bonds, or other similar methods. In a preferred embodiment, the support guide member 180 comprises a removable pin and is mounted onto the support plate 130 by conventional mechanical fasteners. Alternatively, the support guide member 180 may be manufactured as an integral part of the support plate 130.

The rotating member 120 includes a rotary support member 310, a first locking member 320, and a second locking member 330. Counter-clockwise rotation of the rotating member 120 about the rotation axis 290 causes the first and second locking members, 320 and 330, to lock the tensile member 300 against the first and second cam surfaces, 270 and 280, of the first and second cam members, 150 and 170. Conversely, clockwise rotation of the rotating member 120 about the rotation axis 290 releases the tensile member 300 and permits adjustment of the length of the tensile member 300 which extends from the lifting sling 100. In this manner, the lifting sling 100 permits the relative position between two or more objects to be adjusted and then fixed. In a preferred embodiment, the lifting sling 100 includes a pair of cam members, 150 and 170, and a pair of locking members, 320 and 330. Alternatively, the lifting sling 100 may utilize a single cam member and a single locking member. Furthermore, the cross-sectional shapes of the cam surfaces of the cam members and the corresponding mating surfaces of the locking members may comprise any number of shapes such as, for example, elliptical, parabolic, polygonal, or other similar complementary shapes. In a preferred embodiment, the first and second cam surfaces, 270 and 280, and the first and second locking members, 320 and 330, have cross-sectional shapes which comprise complementary shaped circular segments.

In a particularly preferred embodiment, the first and second locking members, 320 and 330, are substantially wheel-shaped in cross section and the first and second cam support structures, 250 and 260, are substantially circular segments in cross-section to facilitate the movement of the tensile member 300 within the lifting sling 100 while the lifting sling 100 is in the unlocked position as illustrated in FIG. 1*b*.

The rotary support member 310 provides support for the first and second locking members 320 and 330. The rotary support member 310 is supported by the rotary support member 160 in a conventional manner and rotates about the rotation axis 290. The rotary support member 310 may be fabricated from any number of rigid materials such as, for example, metal, plastic, wood, composite, ceramic, or other similar materials.

The first and second locking members 320 and 330 extend from and are supported by the rotary support member 310. In a preferred embodiment, the first and second locking members 320 and 330 extend from and are substantially perpendicular to the plane of the rotary support member 310. In a particularly preferred embodiment, the first and second locking members 320 and 330 are supported on the rotary support member 310 by first and second locking member supports 340 and 350 which extend from and are substantially perpendicular to the plane of the rotary support member 310. The cross-sectional shapes of the first and second locking members 320 and 330 are selected to be approximately complementary to the cross-sectional shapes of the first and second cam surfaces 270 and 280. The first and second locking members 320 and 330 may be fabricated from any number of materials such as, for example, metal, plastic, wood, rubber, ceramic, composite or other similar materials. In a particularly preferred embodiment, the first and second locking members are fabricated from vulcanized rubber.

Figure 1C:
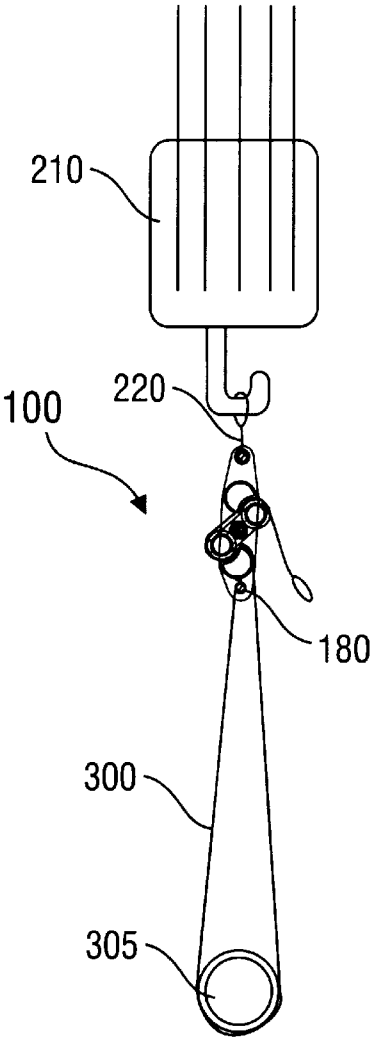
FIG. 1*c* is a front view of another use of the preferred embodiment of the lifting sling in a locked position.
Figure 2B:
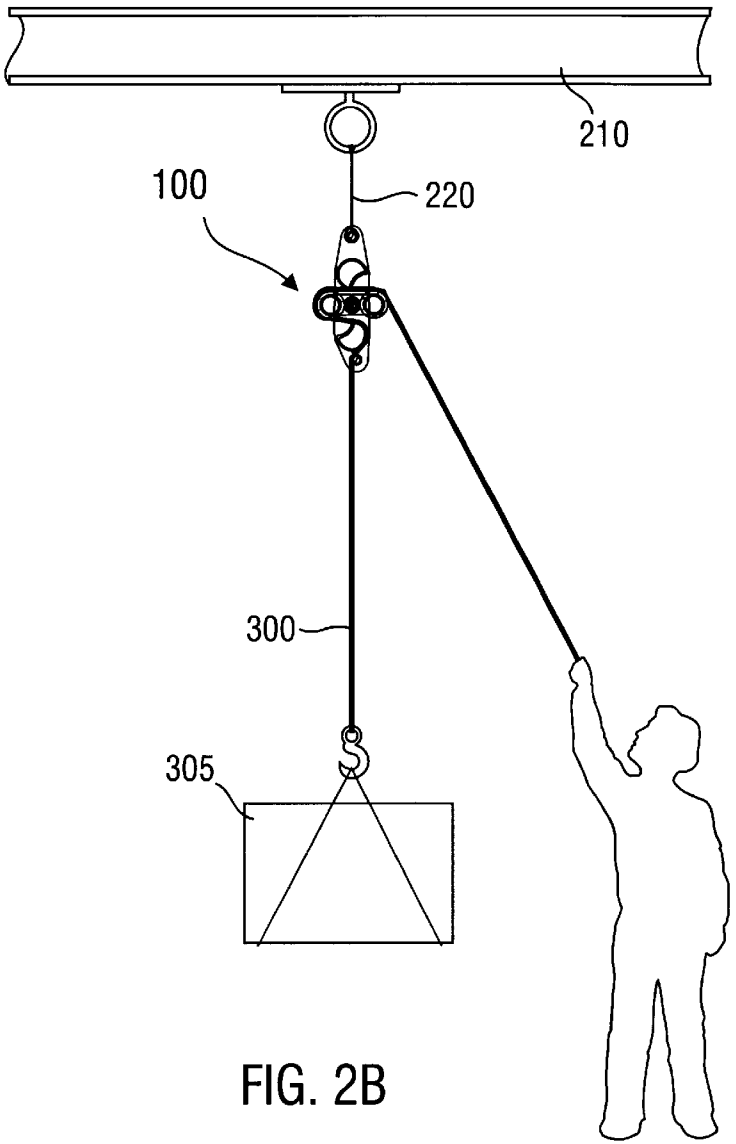
FIG. 2*b* is a front view of the still another use of the preferred embodiment of the lifting sling of FIG. 2*a* in an unlocked position.
Figure 2A:
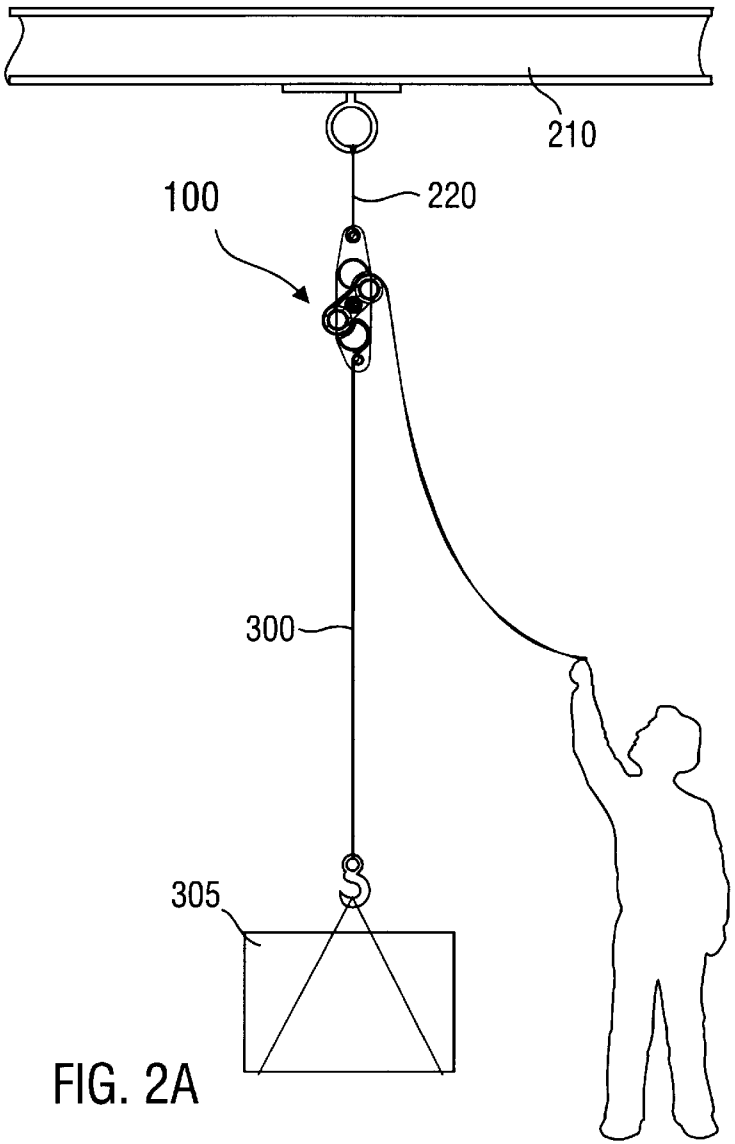
FIG. 2*a* is a front view of still another use of a preferred embodiment of a lifting sling in a locked position.
Figure 3:
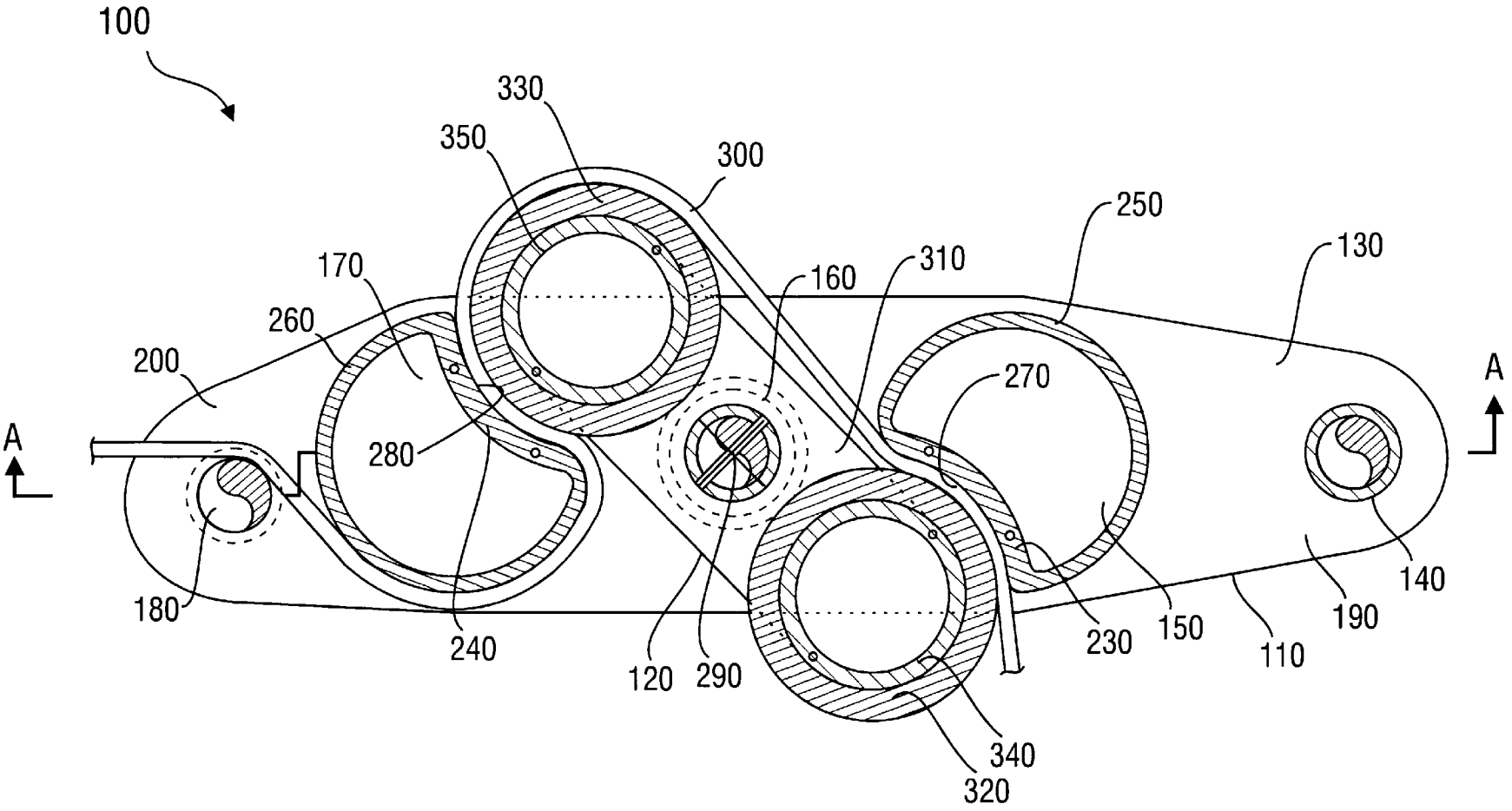
FIG. 3 is a front view of the preferred embodiment of the lifting sling of FIGS. 1*a*, 1*b*, 1*c*, 2*a* and 2*b* in a locked position.

As illustrated in FIGS. 1*a*, 1*b*, 1*c*, 2*a* and 2*b*, in a preferred embodiment, the lifting sling 100 is used in combination with a fixed or movable structure 210, tensile support member 220, and tensile member 300 to adjustably position an object 305 by selectively locking and unlocking the lifting sling 100. In a particularly preferred embodiment, as illustrated in FIGS. 1*a* and 1*b*, an additional fixed tensile member 301 is further utilized to permit objects 306 having a non-uniform weight distribution to be easily and safely held in a desired fixed spatial orientation relative to a fixed or movable structure 210. In an alternative embodiment, as illustrated in FIG. 1*c*, the tensile member 300 is looped about the object 305 and then affixed to an end of the support member 180 using conventional mechanical fasteners.

Figure 4:
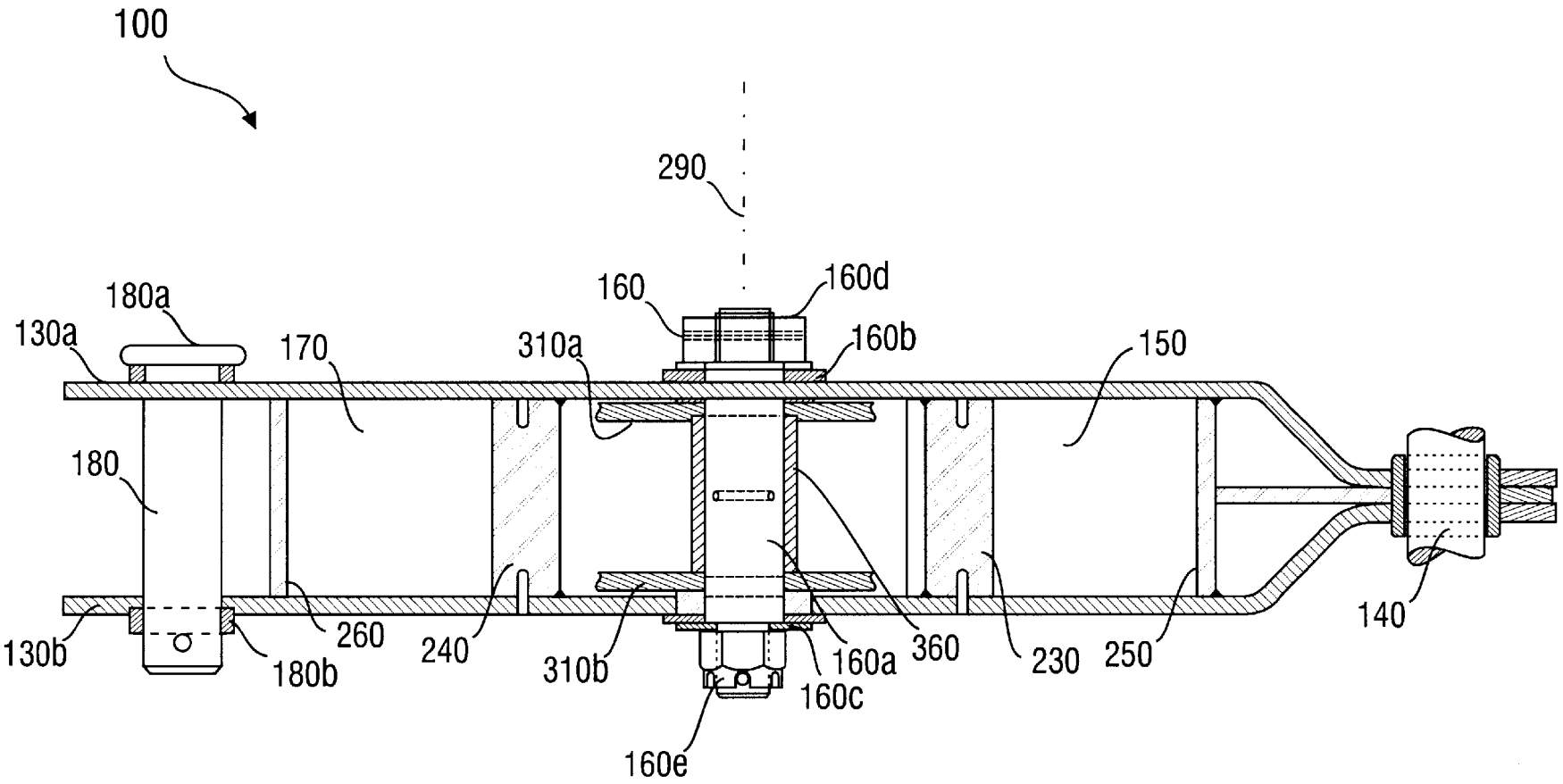
FIG. 4 is a cross-sectional view of the preferred embodiment of the lifting sling of FIG. 3 taken along the line A—A.
Figure 5B:
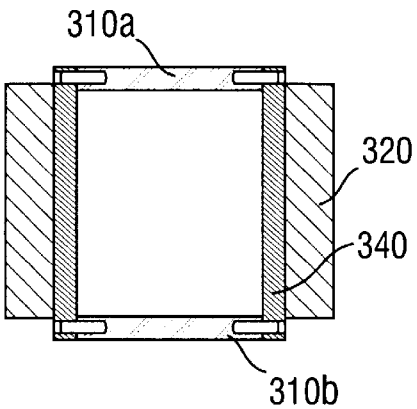
FIG. 5*b* is a cross-sectional view of the rotating member of FIG. 5*a* taken along the line B—B.
Figure 5D:
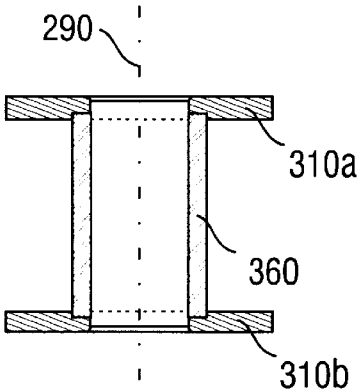
FIG. 5*d* is a cross-sectional view of the rotating member of FIG. 5*a* taken along the line C—C.
Figure 5A:
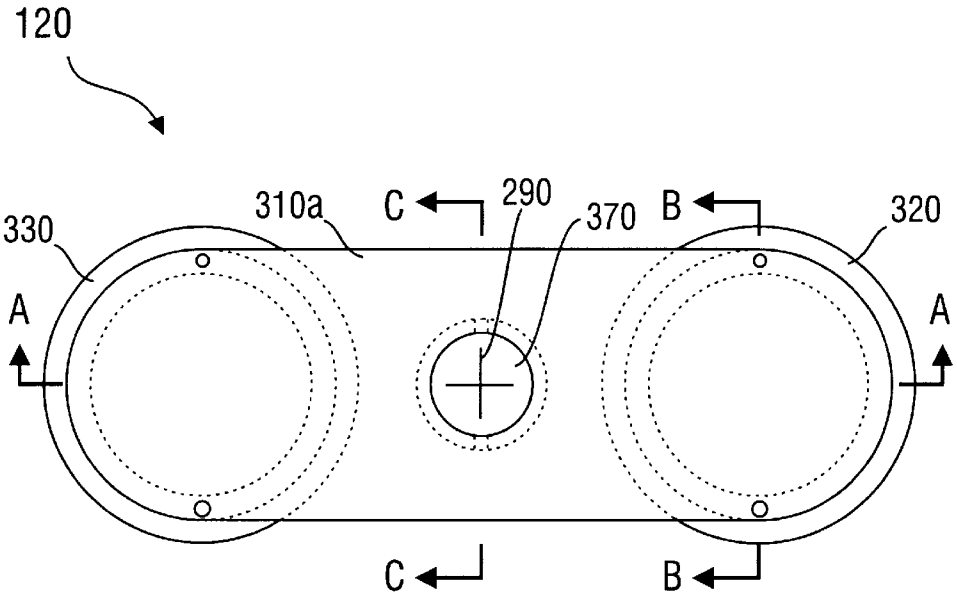
FIG. 5*a* is a front view of the rotating member of the preferred embodiment of the lifting sling of FIG. 4.
Figure 5C:
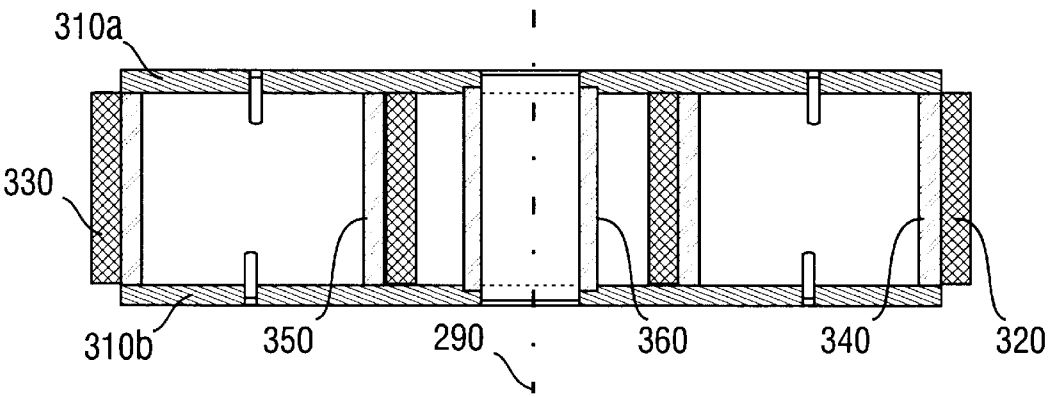
FIG. 5*c* is a cross-sectional view of the rotating member of FIG. 5*a* taken along the line A—A.

Referring now to FIGS. 4, 5*a*, 5*b*, 5*c*, and 5*d*, a particularly preferred embodiment of the lifting sling 100 will be described. As illustrated in FIG. 4, in the particularly preferred embodiment, the stationary member 110 further includes an upper support plate 130*a*, lower support plate 130*b*, a retaining pin 180*a*, a retaining ring 180*b*, a support shaft 160*a*, upper washers 160*b*, lower washers 160*c*, upper retaining nut or cam 160*d*, and lower retaining nut 160*e*.

The upper support plate 130*a* and the lower support plate 130*b* sandwich the first and second cam members 150 and 170, and the rotating member 120 thereby providing a more rigid and durable structure. The retaining pin 180*a* and retaining ring 180*b* provide support and guidance to the tensile member 300. The support shaft 160*a*, upper washers 160*b*, lower washers 160*c*, upper retaining nut or cam 160*d*, and lower retaining nut 160*e* support the rotary member 120.

As illustrated in FIGS. 5*a*, 5*b*, 5*c*, and 5*d*, in the particularly preferred embodiment, the rotary member 120 further includes an upper rotary support member 310*a*, a lower rotary support member 310*b*, a central bearing member 360, and a central passage 370.

The upper rotary support member 310*a* and the lower rotary support member 310*b* together sandwich the first and second locking members 320 and 330 thereby providing a rigid and durable structure. The central bearing member 360 together with the upper and lower rotary support members 310*a* and 310*b* defines the central passage 370. The central passage 370 is substantially centered about the rotation axis 290 and slidably fits around the support shaft 160*a* to permit rotation of the rotating member 120 relative to the stationary member 110.

Figure 6A:
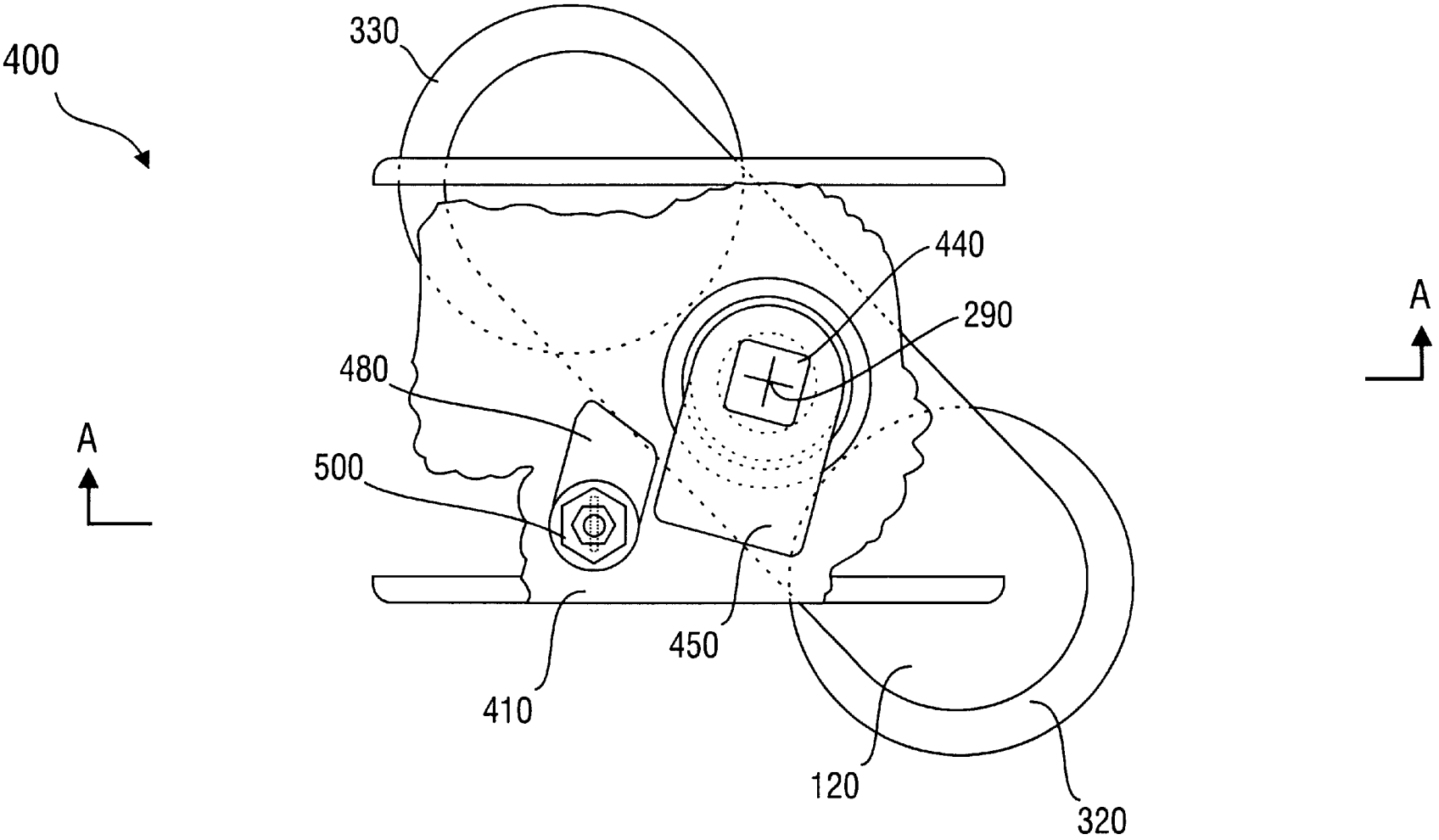
FIG. 6*a* is a fragmentary front view of the cam locking mechanism of the preferred embodiment of the lifting sling in the unlocked position.
Figure 6B:
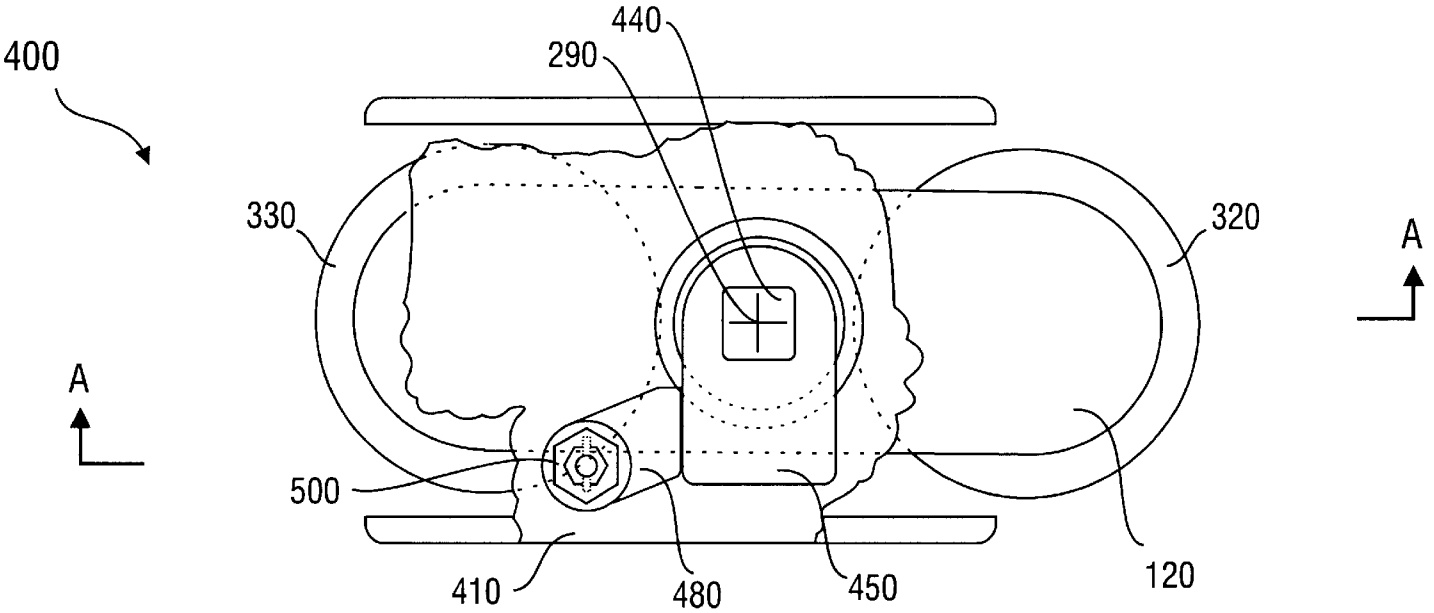
FIG. 6*b* is a fragmentary front view of the cam locking mechanism of the preferred embodiment of the lifting sling in the locked position.
Figure 6C:
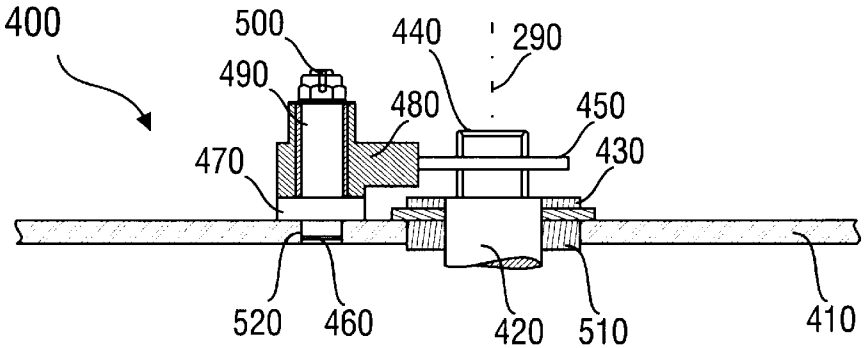
FIG. 6*c* is a cross-sectional view of the locking mechanism of FIG. 6*b* taken along the line A—A.

Referring to FIGS. 6*a*, 6*b*, and 6*c*, a preferred embodiment of a locking mechanism 400 for the lifting sling 100 will now be described. The preferred embodiment of the locking mechanism 400 for the lifting sling 100 includes a mounting plate 410, a drive shaft 420, drive shaft mounting hardware 430, drive cam mounting shaft 440, drive cam 450, control shaft 460, control shaft mounting hardware 470, control cam 480, control cam mounting shaft 490, and control cam retaining hardware 500.

The mounting plate 410 provides support for the remaining portions of the locking mechanism 400. The locking plate may be fabricated from any number of conventional materials such as, for example, metal, plastic, rubber, wood, ceramic, composite or similar materials. In a preferred embodiment, the mounting plate 410 is fabricated from steel. The mounting plate 410 further includes a drive shaft passage 510 and a control shaft passage 520 which permit passage of the drive shaft 420 and control shaft 460 respectively. The mounting plate 410 is attached to the stationary member 110 using conventional methods and may be a separate plate or integral to the support plates 130, 130*a*, or 130*b*.

The drive shaft 420 is connected to the rotary member 120 using conventional methods and thereby permits the locking mechanism 400 to control the rotary position of the rotary member 120. The drive shaft 420 is rotably mounted onto the mounting plate 410 using drive shaft mounting hardware 430. The drive shaft mounting hardware 430 may comprise any number of conventional rotary shaft mounting hardware. In a preferred embodiment, the drive shaft mounting hardware comprises bushings, bearings and nuts. One end of the drive shaft 420 includes the drive cam mounting shaft 440 which permits the drive cam 450 to be removably mounted onto the drive shaft 420. In this manner, the drive cam 450 is able to impart rotary motion to the rotary member 120. The drive cam 450 may be connected to the drive cam mounting shaft 440 using any number of conventional methods such as, for example, splines, drive pins, snap rings, or washers and nuts. In a preferred embodiment, the drive cam 450 is attached to the drive cam mounting shaft 440 by one or more drive pins.

The control shaft 460 is rotably mounted onto the mounting plate 410 within the control shaft passage 520 using the control shaft mounting hardware 470. The control shaft mounting hardware 470 may comprise any number of conventional rotary shaft mounting hardware such as, for example, washers or weldments. In a preferred embodiment, the control shaft mounting hardware comprises an integral hub on control shaft 460 that is welded to the mounting plate 410. One end of the control shaft 460 includes the control cam mounting shaft 490 which removably carries the control cam 480. In this manner, rotation of the control cam 480 can be achieved about the control cam mounting shaft 490. The control cam 480 may be removably mounted onto the control cam mounting shaft 490 using any number of conventional mounting hardware such as, for example, bushings, slip fit, or bearings. In a preferred embodiment, the control cam 480 is removably mounted onto the control cam mounting shaft 490 using bushings. The control cam 480 is further retained upon the control cam mounting shaft 490 by control cam retaining hardware 500. The control cam retaining hardware 500 may comprise any number of conventional mechanical fasteners. In a preferred embodiment, the control cam retaining hardware 500 comprises washers and nuts.

As illustrated in FIGS. 6*a*, 6*b*, and 6*c*, the rotary member 120 may be locked in position by clockwise rotation of the control cam 480. The clockwise rotation of the control cam 480 may be effected using any number of conventional actuation mechanisms such as, for example, an open end wrench, crescent wrench, or socket wrench. In a preferred embodiment, the control cam 480 is rotated into and out of the locked position by a crescent wrench.

A lifting sling has been described having enhanced operating characteristics for maintaining the relative position of a plurality of objects. The lifting sling is especially well suited for application in lifting and maintaining stationary large and heavy objects. The teachings of the present illustrative embodiments will find wide application to the general area of positioning systems and their illustration by means of specific embodiment is not meant to limit their application.

What is claimed is:

1. A lifting sling, comprising:

(a) a stationary member including a first cam member and a second cam member spaced with an axis between them;

(b) a rotary member rotatable mounted to said stationary member at said axis and including a first locking member adapted to substantially mate with said first cam member and a second locking member adapted to substantially mate with said second cam member;

(c) a support member for said stationary member spaced from said axis beyond one of said cam members; and (d) a guide member on said stationary member spaced from said axis beyond the other of said cam members.

2. The lifting sling of claim 1, wherein the cam members on said stationary member are spaced equidistant from said axis.

3. The lifting sling of claim 1, wherein said first cam member includes a cam surface substantially circularly shaped in cross-section.

4. The lifting sling of claim 1, wherein said second cam member includes a cam surface substantially circularly shaped in cross-section.

5. The lifting sling of claim 1, wherein said first locking member is substantially wheel-shaped.

6. The lifting sling of claim 1, wherein said second locking member is substantially wheel-shaped.

7. The lifting sling of claim 1, wherein said stationary member substantially sandwiches said rotary member.

8. The lifting sling of claim 1, further comprising:

(a) a drive cam coupled to said rotary member; and (b) a control cam coupled to said stationary member.

9. The lifting sling of claim 8, wherein said control cam is rotably supported by said stationary member.

10. The lifting sling of claim 1, wherein said first cam member includes a first cam surface and a first cam support having a substantially circular cross-section.

11. The lifting sling of claim 1, wherein said second cam member includes a second cam surface and a second cam support having a substantially circular cross-section.

12. A lifting sling, comprising:

(a) a stationary member including:

(1) a first cam member having a first cam surface and a first cam support structure, said first cam support structure having a cross-sectional shape that is substantially a circular segment; and (2) a second cam member having a second cam surface and a second cam support structure, said second cam support structure having a cross-sectional shape that is substantially a circular segment;

(b) a control cam rotably supported by said stationary member;

(c) a rotary member rotably supported by said stationary member including a first wheel-shaped locking member adapted to substantially mate with said first cam surface and a second wheel-shaped locking member adapted to substantially mate with said second cam surface; and (d) a drive cam coupled to said rotary member.

13. An apparatus for fixing the relative position of a first and second object, comprising:

(a) a stationary member including a first cam member and a second cam member spaced with an axis between them;

(b) a rotary member rotatably mounted to said stationary member at said axis and including a first locking member adapted to substantially mate with said first cam member and a second locking member adapted to substantially mate with said second cam member;

(c) a support member for said stationary member spaced from said axis beyond one of said cam members; and (d) a guide member on said stationary member spaced from said axis beyond the other of said cam members.

14. The apparatus of claim 13, further comprising a tensile member coupled to said first object and to said support member, and a tensile member coupled to said second object and passing by said guide member and between both the first and second cam members and their respective locking members.

15. The apparatus of claim 13 in which the stationary member comprises spaced substantially parallel supports and the rotary member is rotatably mounted between the substantially parallel supports of the stationary member.

16. The apparatus of claim 15 in which a drive cam is coupled to the rotary member and a control cam is coupled to the stationary member to lock the drive cam and the rotary member in a fixed position.

17. The apparatus of claim 16 in which the control cam has a shape for actuation by a wrench.

* * * * *

UNITED STATES PATENT AND TRADEMARK OFFICE

CERTIFICATE OF CORRECTION

PATENT NO. : 5,921,353

DATED : July 13, 1999

INVENTOR(S) : Steven T. Day

It is certified that error appears in the above-identified patent and that said Letters Patent is hereby corrected as shown below:

Column 6, line 63, "rotatable" should be --rotatably--.

Signed and Sealed this

Thirtieth Day of November, 1999

*Attest:*

*Attesting Officer*

Q. TODD DICKINSON

*Acting Commissioner of Patents and Trademarks*